US007013882B2

(12) United States Patent
Long et al.

(10) Patent No.: US 7,013,882 B2
(45) Date of Patent: Mar. 21, 2006

(54) OVER-DWELL PROTECTION CIRCUIT FOR AN AUTOMOTIVE IGNITION CONTROL SYSTEM

(75) Inventors: Jerral A. Long, Kokomo, IN (US); Scott B. Kesler, Kokomo, IN (US); Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/647,946

(22) Filed: Aug. 26, 2003

(65) Prior Publication Data

US 2005/0046278 A1 Mar. 3, 2005

(51) Int. Cl.
*F02P 9/00* (2006.01)

(52) U.S. Cl. ..... 123/609; 123/630

(58) Field of Classification Search ..... 123/609, 123/630, 610, 611, 644
See application file for complete search history.

(56) References Cited

U.S. PATENT DOCUMENTS 4,446,843 A * 5/1984 Rumbaugh et al. ..... 123/609
6,360,720 B1 * 3/2002 Kesler ..... 123/406.55
6,668,811 B1 * 12/2003 Kesler ..... 123/644

* cited by examiner

*Primary Examiner*—Mahmoud Gimie
(74) *Attorney, Agent, or Firm*—Stefan V. Chmielewski

(57) ABSTRACT

An ignition control circuit (12) is responsive to a control signal (ESTC) to apply a drive signal (GD) to a power switching device (22) to conduct ignition coil current ($I_C$) therethrough. A resistor ($R_S$) included within the circuit (12) receives, and dissipates heat generated by, the coil current ($I_C$). The circuit (12) includes a first transistor ($Q_{HOT}$) positioned adjacent to the resistor ($R_S$) such that an operating temperature thereof is near that of the resistor ($R_S$), and a second transistor ($Q_{REF}$) positioned remote from the resistor ($R_S$) and having an operating temperature defining a reference temperature. The first and second transistors ($Q_{HOT}$, $Q_{REF}$) are configured to produce an output voltage ($V_{OUT}$) proportional to a difference in operating temperatures thereof, and a latch circuit (L1) disables the control signal (ESTC) to thereby turn off the power switching device (22) when the output voltage ($V_{OUT}$) difference exceeds a reference voltage ($V_{REF}$).

20 Claims, 3 Drawing Sheets

OVER-DWELL PROTECTION CIRCUIT FOR AN AUTOMOTIVE IGNITION CONTROL SYSTEM

TECHNICAL FIELD

The present invention relates generally to automotive ignition control circuitry employing over-dwell protection, and more specifically to such circuitry providing over-dwell protection via detection of thermal gradients in the ignition control circuitry.

BACKGROUND OF THE INVENTION

Many modern automotive ignition systems are required to provide protection from excessively long dwell events, which are often the result of a system or wiring fault. If such excessively long dwell events are not detected and properly handled, serious damage to control electronics or the associated ignition coils may occur. Conventional automotive ignition systems consist of an interface control integrated circuit operable to control the operation of a power switching transistor configured to drive an associated ignition coil, wherein all such components may be combined in a single coil assembly.

Heretofore, conventional techniques for detecting excessively long dwell events, typically referred to as "over-dwell" events, has included the use of timing circuitry capable of monitoring dwell times ranging from tens to hundreds of milliseconds. Known timing circuitry capable of monitoring dwell times of such duration generally requires either an on-chip oscillator and counter, or an external timing capacitor. It is desirable in automotive ignition circuitry to implement an over-dwell protection function that does not strictly require either a complex integrated circuit design including oscillators and counters, or external timing capacitors.

SUMMARY OF THE INVENTION

The present invention comprises one or more of the following features or combinations thereof. Ignition control circuitry including a first circuit responsive to a control signal to produce a drive signal, a resistor configured to receive a load current resulting from production of the drive signal, wherein the resistor generates heat resulting from dissipating the load current, a second circuit producing an output voltage proportional to a difference between an operating temperature of the resistor and a reference temperature, and a third circuit responsive to the output voltage to disable the control signal, and thereby disable the drive signal, if the output voltage exceeds a reference voltage.

The second circuit may include a differentially connected transistor pair having a first transistor positioned adjacent to the resistor such that an operating temperature of the first transistor is near that of the resistor, and a second transistor positioned remote from the resistor and having an operating temperature defining a reference temperature, wherein the transistor pair produces an output signal proportional to a difference in operating temperatures of the first and second transistors. A fourth circuit may be included and configured to convert the output signal to an output voltage.

The first and second transistors may be bipolar transistors, with the first transistor defining a base electrically connected to a base of the second transistor and an emitter electrically connected to an emitter of the second transistor. The first transistor may define a first collector receiving a first collector current from a first output of a current mirror, and the second transistor may define a second collector receiving a second collector current from a second output of the current mirror, wherein the first and second collector currents each having magnitudes dependent upon the operating temperatures of respective ones of the first and second transistors. The resulting output signal may thus be a difference current corresponding to a difference between the magnitudes of the first and second collector currents.

The second transistor may be positioned relative to the resistor such that the operating temperature of the second transistor is unaffected for a period of time by heat generated by the resistor resulting from dissipating the load current.

The third circuit may include a comparator having a first input receiving the output voltage, a second output receiving a reference voltage and a comparator output, wherein the comparator output switches from a first logic level to a second logic level when the output voltage exceeds the first reference voltage. The third circuit may further include a reference voltage circuit producing the reference voltage with a first magnitude when the comparator output produces the first logic level, and producing the reference voltage with a second lesser magnitude when the comparator output produces the second logic level to thereby provide the comparator with switching hysteresis.

The third circuit may further include a latch having a first input connected to the comparator output, a second input receiving an inverted representation of the control signal and a latch output, wherein the latch output switches from a first state to a second state when the control signal is at a predefined logic state and the comparator output switches from the first logic level to the second logic level.

The third circuit may further include an AND gate having a first input receiving the control signal, a second input connected to the latch output and an AND gate output connected to a control signal input of the first circuit, wherein the AND gate output disables the control signal to the input of the first circuit when the latch output produces the second state, and otherwise passes the control signal to the input of the first circuit.

A power device may also be included having a control input receiving the drive signal, a load input electrically connected to an electrical load and a load output electrically connected to the resistor, wherein the power device is responsive to the drive signal to conduct the load current from the electrical load through the resistor. The electrical load may be an automotive ignition coil having one end electrically connected to a voltage source and an opposite end connected to the load input of the power device.

These and other features of the present invention will become more apparent from the following description of the illustrative embodiments.

DESCRIPTION OF THE ILLUSTRATIVE EMBODIMENTS

Figure 1:
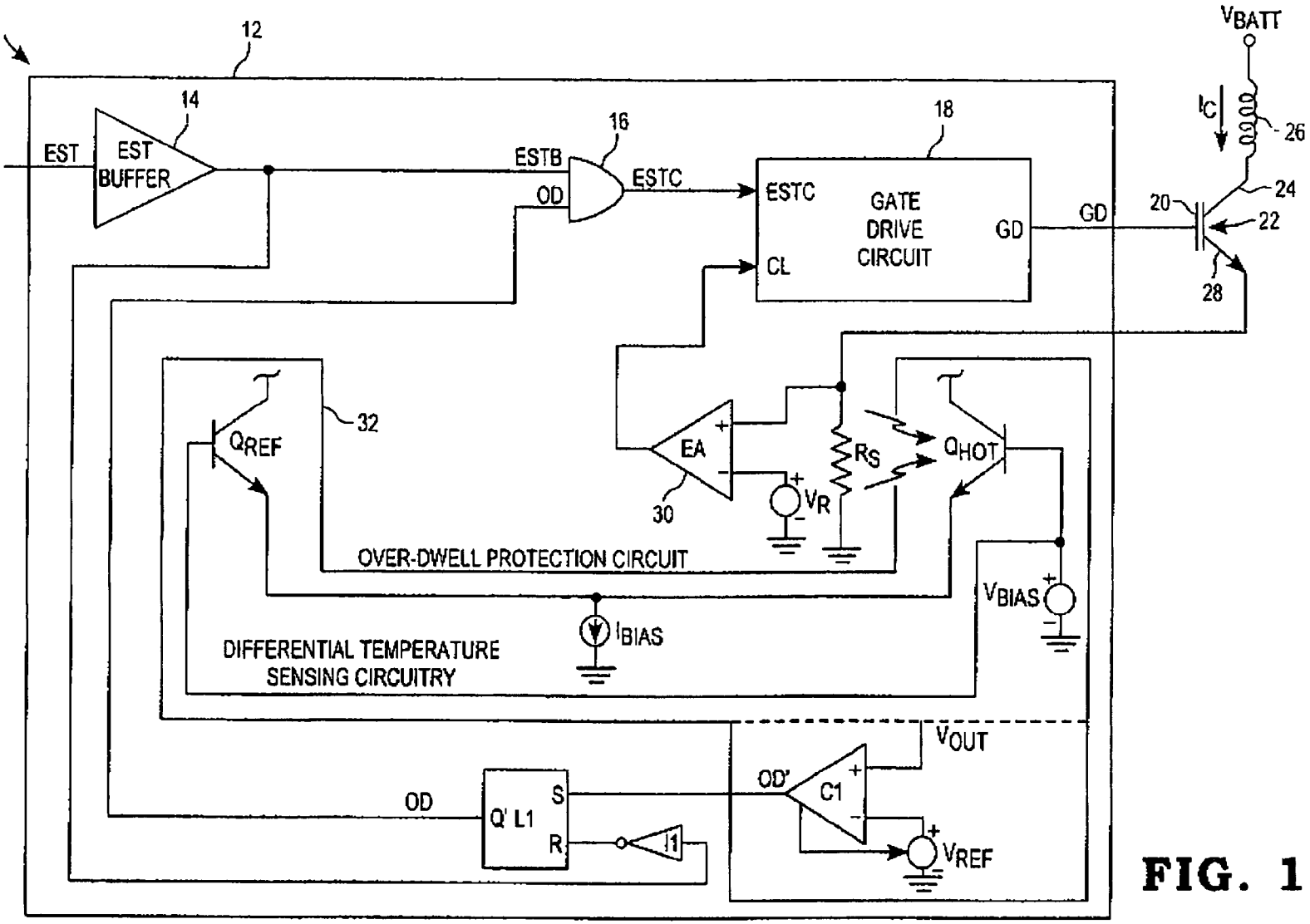
FIG. 1 is a high level schematic diagram of one illustrative embodiment of an automotive ignition control system including an ignition control circuit configured to control ignition over-dwell events via detection of thermal gradients generated therein by the ignition coil current.

Referring now to FIG. 1, a high level schematic diagram is shown illustrating one embodiment of an automotive ignition control system 10 including an ignition control circuit 12 configured to control ignition over-dwell events via detection of thermal gradients generated therein by the ignition coil current $I_C$. Ignition control circuit 12 includes an electronic spark timing (EST) buffer 14 of known construction and having an input receiving an EST signal from an external source. In one embodiment, the EST signal is generated by a control computer (not shown), such as an engine control computer, although it is to be understood that the EST signal may alternatively be generated by other known circuitry. In any case, the output of the EST buffer 14 is connected to one input of a two-input AND gate 16, and the EST buffer 14 is operable to provide a buffered version, ESTB, of the EST signal to AND gate 16. The output of AND gage 16 is connected to an EST control input, ESTC, of a gate drive circuit 18 of known construction. A gate drive output, GD, of the gate drive circuit 18 defines a gate drive output, GD, of the ignition control circuit 12.

The gate drive output, GD, of the ignition control circuit 12 is connected to a control input 20 of a coil driving device 22, and in the embodiment illustrated in FIG. 1, the coil driving device 22 is an insulated gate bipolar transistor (IGBT) defining a gate 20 connected to the GD output of circuit 12, a collector 24 connected to one end of a primary coil 26 of an automotive ignition coil and an emitter 28. The opposite end of the primary coil 26 is connected to a suitable voltage source, such as automotive battery voltage, $V_{BATT}$. IGBT 22 is responsive to a high-level GD signal at its gate 20 to conduct a coil current, $I_C$, therethrough from its collector 24 to its emitter 28, as is known in the art. Those skilled in the art will recognize that the coil driving device 22 may alternatively be, or include, other known coil driving devices, and examples of such alternative embodiments of device 22 may include, but are not limited to, a power metal-oxide semiconductor field effect transistor (power MOSFET), a bipolar power transistor circuit, a power relay device, or the like.

The emitter 28 of coil driving device 22 is connected to one end of a sense resistor, $R_S$, comprising part of the ignition control circuit 12 and having an opposite end connected to ground potential. The emitter 28 is also connected to a non-inverting input of an error amplifier 30 of known construction and having an inverting input connected to a reference voltage source $V_R$. The output of the error amplifier 30 is connected to a current limit input, CL, of the gate drive circuit 18.

Figure 2:
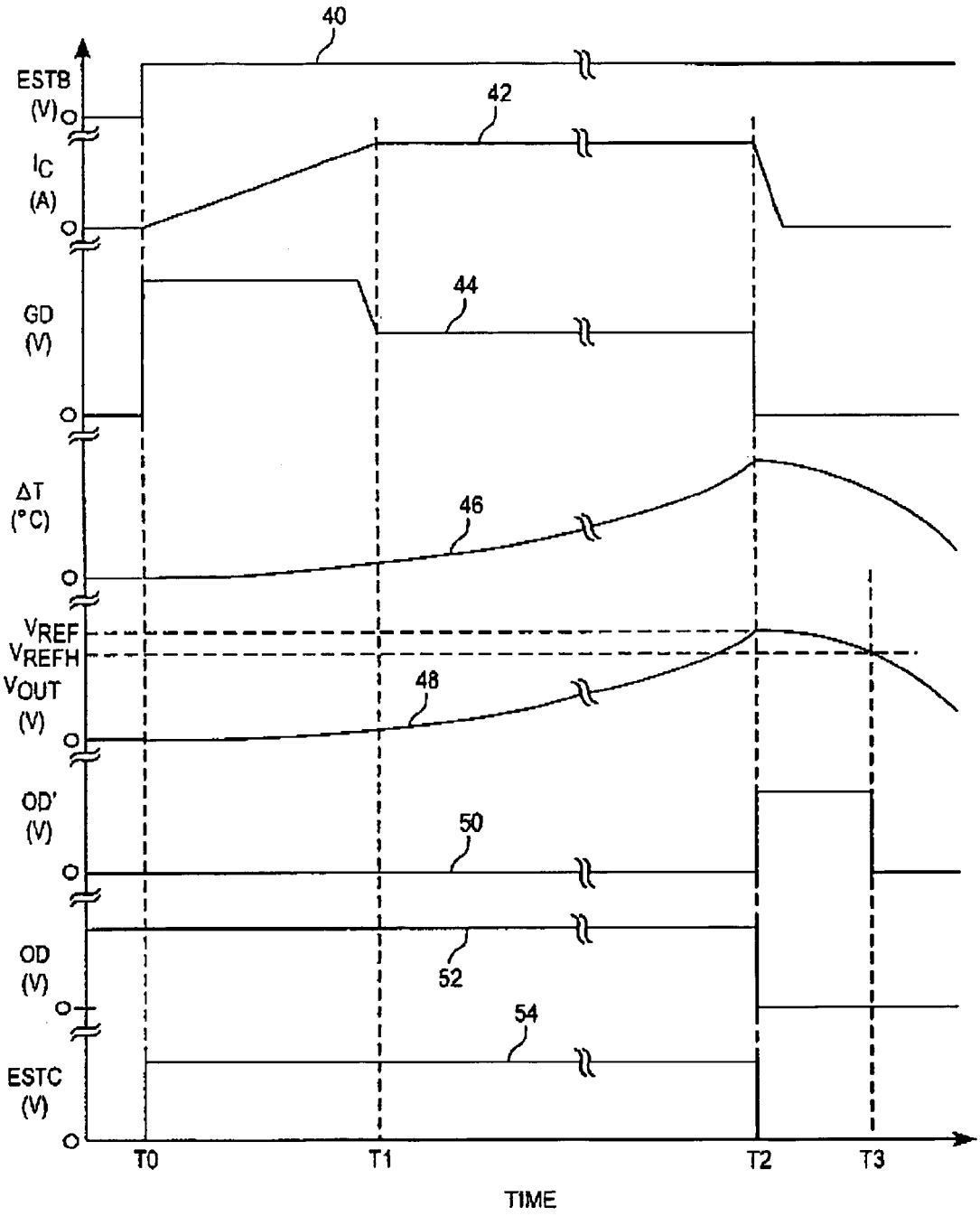
FIG. 2 is a plot of various operating conditions vs. time illustrating operation of the automotive ignition control system of FIG. 1 in controlling ignition over-dwell events.

With the exception of the AND gate 16, the circuitry described thus far is conventional, and the normal operation thereof is illustrated in FIG. 2 by the ESTB, $I_C$ and GD signals. For example, referring to FIG. 2, when the ESTB signal 40 transitions from a low to a high state, and assuming for now that the second input, OD, of the AND gate 16 is set at a high state, the gate drive circuit 18 is responsive to the resulting transition of the ESTC signal from a low to a high level to supply a high-level gate drive signal, GD, to the gate 20 of IGBT 22. IGBT 22 is, in turn, responsive to the high-level gate drive signal, GD, to begin conducting the coil current, $I_C$, therethrough. Because the primary coil 26 is an inductive load, the coil current $I_C$ will rise linearly with a constant gate voltage, GD, applied to the gate 20 of IGBT 22, and the voltage across the resistor $R_S$ will likewise rise linearly with $I_C$. When the voltage across $R_S$ reaches the reference voltage, $V_R$, the output of the error amplifier 30 changes linearly, and the gate drive circuit 18 is responsive to this error amplifier output at the current limit input, CL, to correspondingly linearly decrease the gate drive voltage, GD, to a level at which the coil current, $I_C$, is limited to a constant level.

Referring again to FIG. 1, the ignition control circuit 12 further includes an over-dwell protection circuit 32 having an over-dwell output, OD', connected to a "set" input of a latch L1. The output of the EST buffer circuit 14 is connected to the input of an inverter I1 having an output connected to the "reset" input of latch L1. A Q' output of latch L1 produces an over-dwell signal that is connected to the second input of the AND gate 16. In one embodiment, all of the circuitry represented in FIG. 1 as being included within the ignition control circuit 12 is integrated into a single, monolithic integrated circuit fabricated in accordance with a known bipolar integrated circuit fabrication process. Those skilled in the art will recognize, however, that circuit 12 may alternatively be constructed as a combination of multiple integrated circuits, and/or may be fabricated in accordance with other known integrated circuit fabrication processes.

The over-dwell protection circuit 32 includes a first transistor $Q_{HOT}$ positioned adjacent to the sense resistor, $R_S$, such that the operating temperature of $Q_{HOT}$ is near that of $R_S$ and therefore generally tracks the operating temperature of $R_S$ as it varies resulting from conduction of the coil current, $I_C$, therethrough. While heat generated by $R_S$ resulting from dissipation thereby of the coil current, $I_C$, will generally emanate in all directions from $R_S$, heat generated by $R_S$ for purposes of illustration is represented in FIG. 1 as a pair of arrow-tipped wavy lines directed generally from $R_S$ toward transistor $Q_{HOT}$. A second transistor, $Q_{REF}$, is positioned sufficiently remote from $Q_{HOT}$ such that its operating temperature is generally unaffected by that of $R_S$ for at least the period of time defining an over-dwell event.

Thusly positioned, the operating temperature of $Q_{REF}$ will generally be defined by a combination of its collector current, the operating temperature of its surrounding circuitry and the temperature of the environment in which the ignition control circuit 12 is operating. The bases of $Q_{HOT}$ and $Q_{REF}$ are connected together and to a constant voltage source $V_{BIAS}$, and the emitters of $Q_{HOT}$ and $Q_{REF}$ are connected together and to a constant current source $I_{BIAS}$. The output, $V_{OUT}$, of the over-dwell protection circuit 32 is connected to a non-inverting input of a comparator C1 having an inverting input connected to a voltage source $V_{REF}$ and an output defining the over-dwell output, OD', of the over-dwell protection circuit 32. As will be described in greater detail hereinafter, the voltage source $V_{REF}$ is configured to produce a voltage having a first magnitude when the output of C1 is low, and to produce a voltage having a second lesser magnitude when the output of C1 is high to thereby provide comparator C1 with switching hysteresis.

The over-dwell protection circuit 32 is configured to detect excessive dwell times by making use of the normal propagation time for a thermal wave to move across an integrated circuit (IC) die. In general, any power-dissipating element on an IC will produce heat that must spread into the surrounding bulk silicon. Since this thermal spreading has an inherent propagation speed, circuitry (e.g., $Q_{REF}$) located some distance away from the power-dissipating element (e.g., $R_S$) will be at a lower temperature than circuitry (e.g., $Q_{HOT}$) located very near to the power dissipating element for a period of time defined by the propagation speed of heat in the bulk silicon. By taking advantage of this brief mismatch in temperatures, the over-dwell circuit 32 implements a function that is in effect a thermal clock. Given die sizes typically found in modern ignition control integrated circuits, this clock can be used to detect over-dwell events with durations in the range of 10 to 50 milliseconds. These times are similar to the over-dwell timeout times found in specifications of many ignition systems. Since the operation of the over-dwell protection circuit 32 is based on temperature differences between $Q_{HOT}$ and $Q_{REF}$ rather than on absolute operating temperatures of the two transistors, circuit 32 is inherently insensitive to initial die temperature and will accordingly function identically at any initial die temperature.

Under the normal operating conditions described above, ignition coil current, $I_C$, is periodically ramped to its current-limited value for "normal" dwell durations before being disabled by IGBT 22. During these normal dwell durations, the thermal waves propagating across the ignition control circuit die 12 from the coil current sense resistor, $R_S$, (and the nearby transistor $Q_{HOT}$) to the location of $Q_{REF}$ will generally not develop to the same magnitude as what will occur in the case of excessively long dwell events. During excessively long dwell events, the heat generated by the coil current sense resistor, $R_S$, resulting from the dissipation thereby of the coil current, $I_C$, will continue to raise the temperature of the nearby transistor $Q_{HOT}$ to a level higher than would occur for the normal dwell duration case. This extra difference in temperature between $Q_{HOT}$ and $Q_{REF}$ under excessive dwell events is detectable by the over-dwell protection circuit 32, and circuit 32 is configured to react to such an over-dwell fault event by disabling the gate drive signal, GD, to thereby turn off IGBT 22 and stop the flow of coil current, $I_C$, through the primary coil 26, IGBT 22 and sense resistor, $R_S$, thereby protecting the ignition control circuit 12, IGBT 22 and/or ignition coil 26. The over-dwell fault condition is not reset until the electronic spark timing (EST) input signal returns to a non-asserted state. If this occurs, normal operation can resume on the next EST pulse.

In order to produce a thermal gradient large enough to accurately detect during an over-dwell event, the power dissipated by $R_S$ must be sufficiently high. It is also desirable that the power dissipated be relatively constant or predictable. Because the coil current $I_C$ is limited to a constant value by the action of the existing error amplifier 30 and gate drive circuitry 18 as described hereinabove, the power dissipated by the current sensing resistor $R_S$, defined as $I_C^2 * R_S$, is a well-behaved and predictable thermal source. The power dissipated by $R_S$ may thus be adjusted via appropriate choice of the value of $R_S$. The change in power dissipation that would result from changes in the absolute value of the sense resistor with steady state temperature can easily be compensated for in the reference voltages required for the implementation of circuit 32.

The comparator C1 detects the varying voltage developed by the over-dwell protection circuitry 32 and is produced at output $V_{OUT}$. When a sufficient output voltage, $V_{OUT}$, corresponding to a pre-determined temperature difference between $Q_{HOT}$ and $Q_{REF}$, appears at the non-inverting input of C1, the output of C1 produces a high level signal that sets the over-dwell latch, L1, and modifies the reference voltage, $V_{REF}$, to induce a desired amount of comparator hysteresis. When L1 is set, its Q' output transitions from a high level to a low level, thereby forcing the ESTC output of the AND gate 16 to a low state. The gate drive circuit 18 is responsive to the low ESTC signal to force the gate drive signal, GD, to a low state, thereby turning off the IGBT 22 and disabling coil current flow therethrough. When the buffered EST signal thereafter transitions to a low state, latch L1 is reset, and normal operation of ignition system 10 may resume.

Figure 3:
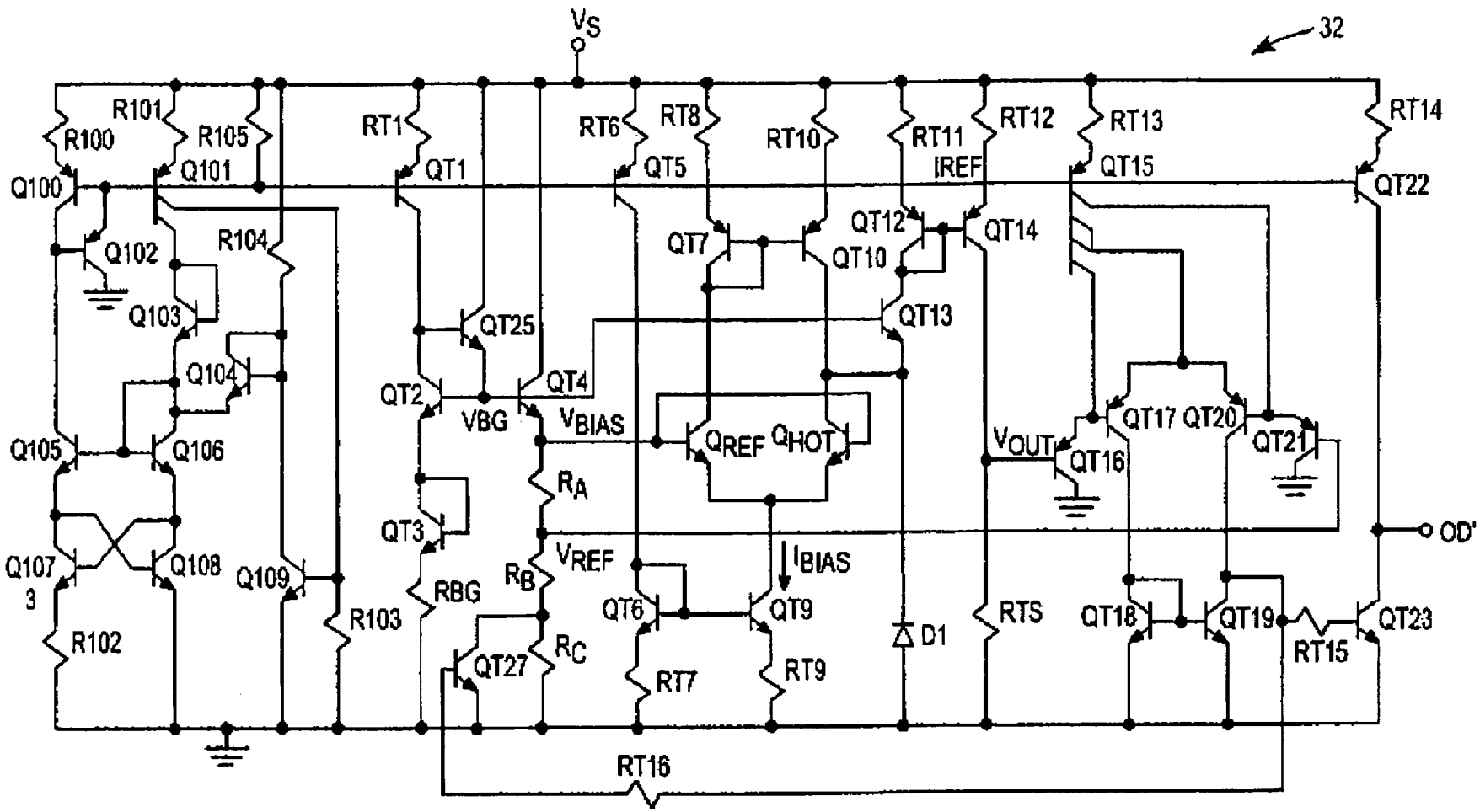
FIG. 3 is a device level schematic diagram of one illustrative embodiment of the over-dwell protection circuitry comprising part of the ignition control circuit illustrated in FIG. 1.

Referring now to FIG. 3, a device level schematic of one illustrative embodiment of the over-dwell protection circuit 32 and comparator C1, along with supporting bias and voltage reference circuitry, is shown. Transistors Q100–109 and resistors R100–105 comprise a reference current generator of the type known as a "delta-Vbe" generator, wherein the resulting "delta-Vbe" current, IREF, is a standard building block current familiar to those skilled in the art. The reference current, IREF, has a slight positive temperature coefficient (T.C.) and is defined by the equation:

$$IREF = Vt * \ln(N)/R102 \quad (1),$$

where Vt is the thermal voltage defined by (k×T)/q, and N is a constant defined by the ratio of emitter areas of the NPN transistors used to develop IREF. In the expression for Vt, "k" is Boltzmans constant, "T" is the temperature in degrees Kelvin, and "q" is the electronic charge. This reference current generator provides a relatively supply independent bias current, IREF, for use by the remaining components of the over-dwell protection circuit 32.

By forcing the delta-Vbe current, IREF, across the series combination of QT2, QT3 and RBG, a simple silicon bandgap reference voltage, VBG, is created at the base of QT2. By proper choice of the value of resistor RBG, the voltage at the bases of QT2 and QT4 will be substantially constant over temperature, and have a magnitude of approximately 2.5V (equal to two times the silicon bandgap voltage of 1.24 volts). This voltage, VBG, is then decreased by the base-emitter voltage ("Vbe") of QT4, creating the voltage $V_{BIAS}$ at the bases of $Q_{REF}$ and $Q_{HOT}$ (see also FIG. 1). Due to the negative T.C. of the Vbe of QT4, $V_{BIAS}$ exhibits a positive temperature coefficient.

The bias voltage, $V_{BIAS}$, is impressed across three series resistors, RA, RB and RC. Through appropriate choice of the values of RA, RB and RC, the reference voltage, $V_{REF}$, is generated between RA and RB as a fractional amount of $V_{BIAS}$, wherein $V_{REF}$ is the reference voltage applied to the inverting input of comparator C1 as shown in FIG. 1. Comparator C1 is composed of transistors QT15–QT23 and resistors RT13–RT15. This is a conventional comparator configuration, and the OD' output of C1, provides a logic signal indicating the status of over-dwell detection. The collector of QT19 is directed through resistor RT16 to the base of transistor QT27 having a collector and emitter connected across resistor RC. As long as VOUT is low, QT27 is in an off state and $V_{REF}$ is defined according to the equation:

$$V_{REF} = V_{BIAS} * (RB+RC)/(RA+RB+RC) \quad (2).$$

However, when $V_{OUT}$ transitions to a high state, QT27 turns on, and $V_{REF}$ is then defined according to the equation:

$$V_{REF} = V_{SAT} + RB * [(V_{BIAS} - V_{SAT})/(RA+RB)] \quad (3),$$

where $V_{SAT}$ is the collector-emitter saturation voltage of QT27. Through appropriate choice of the values of RA, RB and RC, the magnitude of $V_{REF}$ when $V_{OUT}$ is greater than when $V_{OUT}$ is high. The amount of this shift in $V_{REF}$ establishes the amount of thermal hysteresis that will be present in the overall over-dwell protection circuit 32.

The actual thermal gradient detection is performed by the thermal sensing circuitry composed of transistors QT7, QT9, QT10, $Q_{REF}$ and $Q_{HOT}$, and resistors RT8–RT10. Transistors QT7, QT10, $Q_{REF}$ and $Q_{HOT}$ are connected in what is essentially a differential pair configuration with the exception that instead of different signals being applied to the bases of $Q_{REF}$ and $Q_{HOT}$, these bases are tied together and connected to the reference voltage $V_{BIAS}$. The total current, $I_{BIAS}$, drawn by this differential pair (see also FIG. 1) is established by transistors QT5, QT6 and QT9 and resistors RT6, RT7 and RT9.

Initial examination of the configuration of QT7, QT10, $Q_{REF}$ and $Q_{HOT}$ would seem to indicate that this circuit is always in balance with equal collector currents in both $Q_{REF}$ and $Q_{HOT}$. However, this thermal sensing circuitry is actually distributed across two locations on the integrated circuit, with the $Q_{HOT}$ leg of the thermal sensing circuit positioned very near the sense resistor $R_S$ (see FIG. 1), and with the $Q_{REF}$ leg positioned remote from $R_S$. The spacing between the hot side components and the reference components is important in establishing the over-dwell detection time. For example, it is desirable to position the $Q_{REF}$ components at a location on the die that will not be affected by thermal impulses generated in $R_S$ until the desired over-dwell determination period has passed.

The difference in the temperatures of $Q_{REF}$ and $Q_{HOT}$ that occurs as $R_S$ dissipates the impulse coil currents, $I_C$, results in a tip in the differential balance causing $Q_{HOT}$'s collector current to increase as the temperature of this device increases. This excess or differential current required by $Q_{HOT}$ under such conditions is pulled from the emitter of QT13, whose base is biased at VBG. This differential current is then mirrored by the PNP current mirror composed of QT12 and QT14 along with resistors RT11 and RT12. The mirrored differential current is forced onto resistor RTS, thereby developing across RTS the voltage $V_{OUT}$ that is proportional to the differential current between $Q_{REF}$ and $Q_{HOT}$. Diode D1 acts to clamp the voltage at the emitter of QT13, protecting QT13's base-emitter junction from reverse breakdown in the event that $Q_{REF}$ should ever conduct more current than $Q_{HOT}$, an event that may occur due to device mismatches when the control die is at thermal equilibrium. Also, by choosing to bias the thermal sensing circuitry with a current, $I_{BIAS}$, that is dependent upon a resistor, RT9, composed of the same integrated circuit diffused resistor material as that used for construction of RTS, the circuit becomes insensitive to variations in the sheet resistivity of the two diffused resistors.

The voltage developed across RTS exhibits a positive temperature coefficient. By proper choice of the bias current, $I_{BIAS}$, applied to the thermal sensing circuitry, this temperature coefficient can be set to be the same as the T.C. of an NPN base-emitter junction voltage. It is for this reason that $V_{REF}$ is derived from $V_{BIAS}$, a voltage that was intentionally set up to exhibit a positive T.C. that is equal to an NPN Vbe voltage. The total resistance in the resistor divider composed of RA, RB, and RC establishes the current flowing in QT4 and can therefore be used to adjust the T.C. of QT4's Vbe to match that of the voltage across RTS. The calculations required to establish this balance can be performed by one skilled in the art.

The base-emitter voltage (Vbe) of either transistor $Q_{HOT}$ and $Q_{REF}$ is defined by the equation:

$$Vbe(Ic,\ T)=Vt(T)*\ln[Ic/Is(T)] \quad (4),$$

where Ic is the transistor's collector current, and Is(T) is defined by the equation:

$$Is(T)=IS*[(T+273.15)/Tnom]^{XTI}*\exp[\{[(T+273.25)/Tnom]-1\}*EG/Vt(T)] \quad (5)$$

where EG=1.11, Tnom is 298.15 degrees K, and IS and XTI are developed from modeling procedures for one known semiconductor fabrication process employing a known transistor geometry. Values for such parameters will generally be known to those skilled in the art given a particular semiconductor fabrication process and transistor geometry. It is also known that the sum of the collector currents of $Q_{HOT}$ and $Q_{REF}$ equal the bias current, $I_{BIAS}$, established at the collector of QT9, which is given by the equation:

$$Ic_{HOT}+Ic_{REF}=I_{BIAS} \quad (6).$$

Since the bases of $Q_{HOT}$ and $Q_{REF}$ are tied together, as are their emitters, their base-emitter voltages (Vbe) are forced to be equal. As the temperature of $Q_{HOT}$ increases when a current pulse occurs through $R_S$, its collector current, $Ic_{HOT}$ must also increase in order to maintain the same Vbe as that of $Q_{REF}$. However, since $Q_{REF}$ has not yet been exposed to the increased temperature resulting from the current pulse through $R_S$, its collector current, $Ic_{REF}$, remains unchanged. Because QT10's collector current is a 1:1 mirror of $Q_{REF}$'s collector current, $Ic_{REF}$, QT10 can therefore source only a maximum of $Ic_{REF}$ to $Q_{HOT}$. Any excess collector current, or differential collector current, required by $Q_{HOT}$ to maintain the same Vbe as that of $Q_{REF}$ under such conditions is pulled from the emitter of QT13. The initial balance in the collector currents, $Ic_{HOT}$ and $Ic_{REF}$ of $Q_{HOT}$ and $Q_{REF}$ respectively, will be established regardless of the overall temperature of the die. It is the difference in temperatures of these two transistors that triggers the shutdown of the coil current, $I_C$, not the absolute temperatures of either or both of the transistors.

In general, the over-dwell detection time of circuit 32 is a function of the rate of temperature change between $Q_{HOT}$ and $Q_{REF}$ for the expected power dissipation level in $R_S$, and of the spacing between the two transistors. A desired over-dwell detection time can thus be implemented through appropriate choice of the temperature change rate and transistor spacing, and can be determined either experimentally or analytically by one skilled in the art. Once this rate of temperature change is defined for the particular design and semiconductor fabrication process, the equations (4)–(6) can be used to determine the magnitude of the differential current and how it changes with time during a thermal pulse event. The over-dwell detection time can be adjusted by modifying the value of RTS, decreasing RTS to lengthen the over-dwell time or increasing RTS to shorten the time.

Referring again to FIG. 2, operation of the ignition control circuit 12 of FIG. 1 during an over-dwell event will now be described. As described hereinabove, ESTB 40 transitions from a low level to a high level at time T0 (pursuant to a like transition of EST), at which time it will be presumed that the Q' output, OD 52, of latch L1 is reset (high state). ESTC 54 accordingly transitions to a high state coincident with that of ESTB 40, and the gate drive circuit 18 is responsive to this ESTC transition to produce a high level gate drive signal, GD 44. IGBT 22 begins to conduct a linearly increasing current, $I_C$ 42, through coil 26, and when the coil current 42 nears its current limit value (T1), the error amplifier 30 causes the gate drive circuit 18 to reduce GD 44 in a manner that limits the coil current 42 to a constant current limited value as described hereinabove. As the sense resistor, $R_S$, dissipates the current-limited coil current, $I_C$ 42, the temperature of nearby $Q_{HOT}$ rises such that the temperature difference, ΔT 46 between $Q_{HOT}$ and $Q_{REF}$ likewise increases, as does the $V_{OUT}$ voltage 48 of the over-dwell protection circuit 32. Under normal operating conditions (i.e., normal-duration dwell events), the EST signal would transition to a low level (as would ESTB 40 and ESTC 54) before $V_{OUT}$ 48 reaches $V_{REF}$. However, under excessively long dwell events, such as when EST (and ESTB 40) remains in a high state as the result of a system, wiring, etc. problem or failure, the IGBT 22 remains on and coil current, $I_C$ 42 continues to flow through $R_S$, thereby increasing the temperature of $R_S$ and of $Q_{HOT}$. At time T2, the temperature differential, ΔT 46, between $Q_{HOT}$ and $Q_{REF}$ becomes large enough so that $V_{OUT}$ 48 exceeds the reference voltage, $V_{REF}$, of the comparator C1. When this occurs, the OD' output 50 of comparator C1 switches from a low to a high state, which sets latch L1 causing its OD output 52 to transition to a low state. The low-level OD signal at the input of AND gate 16 causes ESTC to transition to a low state, and the gate drive circuit 18 is responsive to this transition to disable the gate drive signal, GD 44, which causes the IGBT 22 to turn off and inhibit further flow of coil current, $I_C$ 42, thereby terminating the over-dwell event. Thereafter, as $R_S$ and $Q_{HOT}$ cool, the temperature differential, ΔT 46, between $Q_{HOT}$ and $Q_{REF}$ decreases, as does the output voltage, $V_{OUT}$ 48, of the over-dwell protection circuit 32. At T3, $Q_{HOT}$ cools sufficiently so that the output voltage, $V_{OUT}$ 48, drops below the hysteresis reference voltage level, $V_{REFH}$, of the $V_{REF}$ voltage source. When this occurs, the OD' output 50 of comparator C1 transitions to a low state. At any time after T3 that ESTB 40 transitions to a low state (not shown in FIG. 2), the latch L1 is reset through inverter I1, and the OD output 52 of latch L1 transitions back to a high state. Once this occurs, the ignition control circuit 12 may resume normal operation.

The following TABLE 1 sets forth example resistor values used in one implementation of circuit 32 illustrated in FIG. 3, although those skilled in the art will recognize that such resistor values are only provided by way of example, and that other implementations of circuit 32 may require different resistor values.

TABLE 1

| Resistor | Value (ohms) |
|---|---|
| R100 | 2 k |
| R101 | 2 k |
| R102 | 340 |
| R103 | 25 k |
| R104 | 100 k |
| R105 | 50 k |
| RT1 | 2 k |
| RBG | 6.1 k |
| RA | 2662 |
| RB | 4388 |
| RC | 3 k |
| RT6 | 2 k |
| RT7 | 2 k |
| RT8 | 2 k |
| RT9 | 2 k |
| RT10 | 2 k |
| RT11 | 2 k |
| RT12 | 2 k |
| RT13 | 2 k |
| RT14 | 2 k |
| RT15 | 10 k |
| RTS | 11 k |

While the invention has been illustrated and described in detail in the foregoing drawings and description, the same is to be considered as illustrative and not restrictive in character, it being understood that only example embodiments thereof have been shown and described and that all changes and modifications that come within the spirit of the invention are desired to be protected.

The invention claimed is:

1. Ignition control circuitry including an integrated circuit die and comprising:

a first circuit responsive to a first control signal to produce a drive signal;

a resistor thermally coupled to said die and configured to receive a load current resulting from production of said drive signal, said resistor generating heat resulting from dissipating said load current;

a second circuit producing an output voltage proportional to a difference between an operating temperature of the die adjacent said resistor and a reference temperature of the die at a location spaced from said resistor; and a third circuit responsive to said output voltage to disable said first control signal, and thereby disable said drive signal, if said output voltage exceeds a reference voltage.

2. The circuitry of claim 1 wherein said second circuit includes:

a differentially connected transistor pair including a first transistor positioned adjacent to said resistor such that an operating temperature of said first transistor is near that of said resistor, and a second transistor positioned remote from said resistor and having an operating temperature defining said reference temperature, said transistor pair producing an output signal proportional to a difference in operating temperatures of said first and second transistors; and a fourth circuit operable to convert said output signal to said output voltage.

3. The circuitry of claim 2 wherein said first and second transistors are bipolar transistors, said first transistor defining a base electrically connected to a base of said second transistor and an emitter electrically connected to an emitter of said second transistor.

4. The circuitry of claim 3 wherein said first transistor defines a first collector receiving a first collector current from a first output of a current mirror;

and wherein said second transistor defines a second collector receiving a second collector current from a second output of said current mirror, said first and second collector currents each having magnitudes dependent upon said operating temperatures of respective ones of said first and second transistors;

and wherein said output signal is a difference current corresponding to a difference between said magnitudes of said first and second collector currents.

5. The circuitry of claim 2 wherein said second transistor is positioned relative to said resistor such that said operating temperature of said second transistor is unaffected for a period of time by heat generated by said resistor resulting from dissipating said load current.

6. The circuitry of claim 1 wherein said third circuit includes a comparator having a first input receiving said output voltage, a second output receiving a reference voltage and a comparator output, said comparator output switching from a first logic level to a second logic level when said output voltage exceeds said reference voltage.

7. The circuitry of claim 6 wherein said third circuit further includes a reference voltage circuit producing said reference voltage with a first magnitude when said comparator output produces said first logic level, and producing said reference voltage with a second lesser magnitude when said comparator output produces said second logic level to thereby provide said comparator with switching hysteresis.

8. The circuitry of claim 1 further including a power device having a control input receiving said drive signal, a load input electrically connected to an electrical load and a load output electrically connected to said resistor, said power device responsive to said drive signal to conduct said load current from said electrical load through said resistor.

9. Ignition control circuitry including an integrated circuit die and comprising:

a first circuit responsive to a first control signal to produce a drive signal;

a resistor thermally coupled to said die and configured to receive a load current resulting from production of said drive signal, said resistor generating heat resulting from dissipating said load current;

second circuit including a differentially connected transistor pair including a first transistor positioned adjacent to said resistor and a second transistor positioned remote from said resistor, said transistor pair producing an output signal proportional to a difference in operat ing temperatures of said die at respective locations of said first and second transistors; and a third circuit responsive to said output signal to disable said first control signal, and thereby disable said drive signal, if a magnitude of said output signal exceeds a reference magnitude.

10. The circuitry of claim 9 wherein said first transistor is positioned adjacent to said resistor such that an operating temperature of said first transistor is near that of said resistor;

and wherein said second transistor is positioned relative to said resistor such that said operating temperature of said second transistor is unaffected for a period of time by heat generated by said resistor resulting from dissipating said load current.

11. The circuitry of claim 10 wherein said first and second transistors are bipolar transistors, said first transistor defining a base electrically connected to a base of said second transistor and an emitter electrically connected to an emitter of said second transistor.

12. The circuitry of claim 11 wherein said first transistor defines a first collector receiving a first collector current from a first output of a current mirror;

and wherein said second transistor defines a second collector receiving a second collector current from a second output of said current mirror, said first and second collector currents each having magnitudes dependent upon said operating temperatures of respective ones of said first and second transistors;

and wherein said output signal is a function of a difference current corresponding to a difference between said magnitudes of said first and second collector currents.

13. The circuitry of claim 9 wherein said third circuit includes a comparator having a first input receiving said output signal, a second input receiving a reference voltage having said reference magnitude and a comparator output, said comparator output switching from a first logic level to a second logic level when a voltage level of said output signal exceeds said reference voltage.

14. The circuitry of claim 13 wherein said third circuit further includes a reference voltage circuit producing said reference voltage with a first magnitude when said comparator output produces said first logic level, and producing said reference voltage with a second lesser magnitude when said comparator output produces said second logic level to thereby provide said comparator with switching hysteresis.

15. The circuitry of claim 9 further including a power device having a control input receiving said drive signal, a load input electrically connected to a powered automotive ignition coil and a load output electrically connected to said resistor, said power device responsive to said drive signal to conduct said load current from said ignition coil through said resistor.

16. Ignition control circuitry comprising:

a first circuit responsive to a first control signal to produce a drive signal;

a resistor configured to receive a load current resulting from production of said drive signal, said resistor generating heat resulting from dissipating said load current;

a second circuit producing an output voltage proportional to a difference between an operating temperature of said resistor and a reference temperature; and a third circuit responsive to said output voltage to disable said first control signal, and thereby disable said drive signal, if said output voltage exceeds a reference voltage, wherein said third circuit includes a comparator having a first input receiving said output voltage, a second output receiving a reference voltage and a comparator output, said comparator output switching from a first logic level to a second logic level when said output voltage exceeds said reference voltage, and wherein said third circuit further includes a latch having a first input connected to said comparator output, a second input receiving an inverted representation of a second control signal and a latch output, said latch output switching from a first state to a second state when said second control signal is at a predefined logic state and said comparator output switches from said first logic level to said second logic level.

17. The circuitry of claim 16 wherein said third circuit further includes an AND gate having a first input receiving said second control signal, a second input connected to said latch output and an AND gate output providing said first control signal to a control signal input of said first circuit, said AND gate output disabling said first control signal to said input of said first circuit when said latch output produces said second state and otherwise passing said second control signal to said input of said first circuit.

18. The circuitry of claim 17 wherein said electrical load is an automotive ignition coil having one end electrically connected to a voltage source and an opposite end connected to said load input of said power device.

19. Ignition control circuitry comprising:

a first circuit responsive to a first control signal to produce a drive signal;

a resistor configured to receive a load current resulting from production of said drive signal, said resistor generating heat resulting from dissipating said load current;

a differentially connected transistor pair including a first transistor positioned adjacent to said resistor and a second transistor positioned remote from said resistor, said transistor pair producing an output signal proportional to a difference in operating temperatures of said first and second transistors; and a third circuit responsive to said output signal to disable said first control signal, and thereby disable said drive signal, if a magnitude of said output signal exceeds a reference magnitude, wherein said third circuit includes a comparator having a first input receiving said output signal, a second input receiving a reference voltage having said reference magnitude and a comparator output, said comparator output switching from a first logic level to a second logic level when a voltage level of said output signal exceeds said reference voltage, and wherein said third circuit further includes a latch having a first input connected to said comparator output, a second input receiving an inverted representation of a second control signal and a latch output, said latch output switching from a first state to a second state when said second control signal is at a predefined logic state and said comparator output switches from said first logic level to said second logic level.

20. The circuitry of claim 19 wherein said third circuit further includes an AND gate having a first input receiving said second control signal, a second input connected to said latch output and an AND gate output providing said first control signal to a control signal input of said first circuit, said AND gate output disabling said first control signal to said input of said first circuit when said latch output produces said second state and otherwise passing said second control signal to said input of said first circuit.

* * * * *